US006446377B1

(12) United States Patent
Hollenbach et al.

(10) Patent No.: US 6,446,377 B1
(45) Date of Patent: Sep. 10, 2002

(54) SIGHTING DEVICE

(76) Inventors: Ned J. Hollenbach, 102 Tower Dr., Murfreesboro, AR (US) 71958; Dean N. Williams, 777 E. College, Griffin, GA (US) 30224

( * ) Notice: Subject to any disclaimer, the term of this patent is extended or adjusted under 35 U.S.C. 154(b) by 12 days.

(21) Appl. No.: 09/634,524

(22) Filed: Aug. 8, 2000

(51) Int. Cl.[7] ..... F41G 1/36
(52) U.S. Cl. ..... 42/148; 42/132
(58) Field of Search ..... 42/148, 111, 112, 42/132, 133, 141

(56) References Cited

U.S. PATENT DOCUMENTS

| | | | | | |
|---|---|---|---|---|---|
| 1,160,157 | A | * | 11/1915 | Flues | 42/112 |
| 2,007,019 | A | * | 7/1935 | Lowe | 42/111 |
| 2,610,405 | A | * | 9/1952 | Dickinson | 42/143 |
| 2,795,048 | A | * | 6/1957 | Seymour et al. | 42/148 |
| 3,260,008 | A | * | 7/1966 | Yeomans, Jr. | 42/111 |
| 4,008,536 | A | | 2/1977 | Adams | 42/1 |
| D253,545 | S | * | 11/1979 | Chesnut | 42/148 |
| 4,651,432 | A | | 3/1987 | Bornancini | 33/233 |
| 4,890,407 | A | | 1/1990 | Nichols | 42/100 |
| 4,894,941 | A | | 1/1990 | Karow, Jr. | 42/103 |
| 5,404,667 | A | * | 4/1995 | Schmitter | 42/111 |
| 5,471,777 | A | * | 12/1995 | McDonald | 42/103 |
| 5,638,604 | A | * | 6/1997 | Lorocco | 33/241 |
| D393,306 | S | * | 4/1998 | Couper | D22/109 |
| 5,836,100 | A | | 11/1998 | Stover | 42/103 |
| 5,878,503 | A | * | 3/1999 | Howe et al. | 33/241 |
| 5,930,906 | A | * | 8/1999 | Howe et al. | 33/241 |
| 6,014,830 | A | | 1/2000 | Brown et al. | 42/100 |
| 6,085,427 | A | * | 7/2000 | Persson | 33/241 |
| 6,122,833 | A | * | 9/2000 | Lorocco | 33/241 |

* cited by examiner

*Primary Examiner*—David M. Mitchell
*Assistant Examiner*—Denise J Buckley
(74) *Attorney, Agent, or Firm*—Boyd D. Cox

(57) ABSTRACT

A sighting device comprises a fiber optic element removably mounted on a support bracket which is adapted for attachment to ventilation rib of a gun. The sighting device is primarily for use in low light conditions and can be readily mounted and removed from the gun in immediate response to changing light conditions. In addition, the fiber optic element is removably attached to the support bracket, thereby allowing alternate fiber optic elements to be selectively mounted on the sighting device as desired.

24 Claims, 4 Drawing Sheets

SIGHTING DEVICE

BACKGROUND

The present invention is a sighting device comprising a fiber optic element releasably mounted on a support bracket, whereby the fiber optic element can be interchanged with alternate fiber optic elements as desired. The support bracket has an enhanced clamping action to secure the device to a weapon. The support bracket also enables a user to mount and remove the sighting device from the weapon in a quick and easy manner without using any tools.

Accuracy when firing a weapon is generally of the utmost importance. Such accuracy is related to many factors, one of which includes the effectiveness of the sighting device. Sighting devices assist a user in aiming the weapon with a certain amount of accuracy in order to hit the desired target when the weapon is fired.

Gun sights typically comprise a metal bead or bar. It is generally recognized in the art that the smaller the front sighting device is on a gun, the more accurate the aiming results. However, in low light conditions, such as occur in early morning and evening or under overcast skies, the metal bead or bar becomes difficult to distinguish visually, and the smaller sized bead or bar becomes a liability for aiming.

Sights using light collecting materials, such as fiber optics, have recently been developed that provide improved aiming accuracy due to their high visibility in low light conditions as compared to the metal sights. These low light sights can be mounted for use when the light condition is poor, and then removed when light conditions change and a low light sight is no longer needed. Since such gun sights are often mounted or removed while in the field, it is desirable that the sight be quickly and easily removed from the gun or mounted on the gun. When removing a sighting device, disassembly is often required and tools are necessary to complete the disassembly, as well as the reassembly. Such procedures are frustrating and time consuming. In addition, removing the sighting device in the field necessitates that the user not only carry the unused sighting device afterward, but the tools for disassembly, as well. When excessive hiking accompanies use of the weapon, carrying any additional equipment can be troublesome.

Due to visual limitations or other reasons, it may be desirous to use an alternate fiber optic element having, for example, a different color. In the sighting devices of the prior art, the fiber optic elements are fixedly attached to the respective supporting brackets which prohibit a user from readily changing the fiber optic element on the device, if desired.

SUMMARY

The present invention is directed to a device that satisfies the need for a sighting device that can be easily installed on a wide variety weapons without the use of tools and that can enhance the light absorbing capability of the fiber optic element. Furthermore, the fiber optic element of the sighting device can be easily removed from the support bracket and replaced in the device with another fiber optic element so that a user can alternate fiber optic elements as desired.

In a preferred embodiment of the invention, the sighting device includes a fiber optic element and a support bracket for securing the fiber optic element to a weapon. The support bracket includes a plurality of resilient clips which hold the fiber optic element and an attaching base which clamps the sighting device to the weapon. The resilient clips and the attaching base of the support bracket cooperate to create an enhanced clamping action which holds the sighting device to the weapon during use, but also enables a rapid installation and removal of the device.

The resilient clips comprised by the support bracket partially surround the fiber optic element leaving a lower surface of the fiber optic element uncovered in order to receive light. In addition, the resilient clips are positioned a distance from each other to form spaces therebetween. These spaces between the clips allow the fiber optic element exposure to the surrounding light. In addition, the support bracket of the sighting device has an elongated opening which extends beneath the fiber optic element allowing exposure of the fiber optic element to the surrounding light. These features allow a greater surface area of the optic element to be exposed to the surrounding light hence more light is allowed to be absorbed by the fiber optic element. This increase in light absorption capability by the fiber optic element results in an increased efficiency of the sighting device, wherein the element is more visible to the user.

It is an object of the present invention to provide a sighting device that can be installed on a weapon and removed from the weapon without necessitating the use of tools.

It is an object of the present invention to provide a sighting device that snaps on to and off of the ventilation rib of a gun.

It is an object of the present invention to provide a sighting device with an attaching base that can be mounted securely on the rib of different guns when there may be slight variations in the size of the gun barrel's rib.

It is an object of the present invention to provide a fiber optic sight in which the fiber optic element is removable from the sight's support bracket.

It is an object of the present invention to provide a fiber optic sighting device in which fiber optic elements can be selectively alternated as desired by the user.

It is an object of the present invention to provide a removable gun sight with a support bracket having enhanced strength for securing the sight to a gun.

It is an object of the present invention to provide a fiber-optic sighting device that has enhanced light collecting characteristics.

It is an object of the present invention to provide a fiber optic gun sight having a support bracket that only partially surrounds the fiber optic element.

BRIEF DESCRIPTION OF DRAWINGS

Reference is made to the accompanying drawings in which are shown illustrative embodiments of the invention and from which novel features and advantages will be apparent.

DETAILED DESCRIPTION

Figure 1:
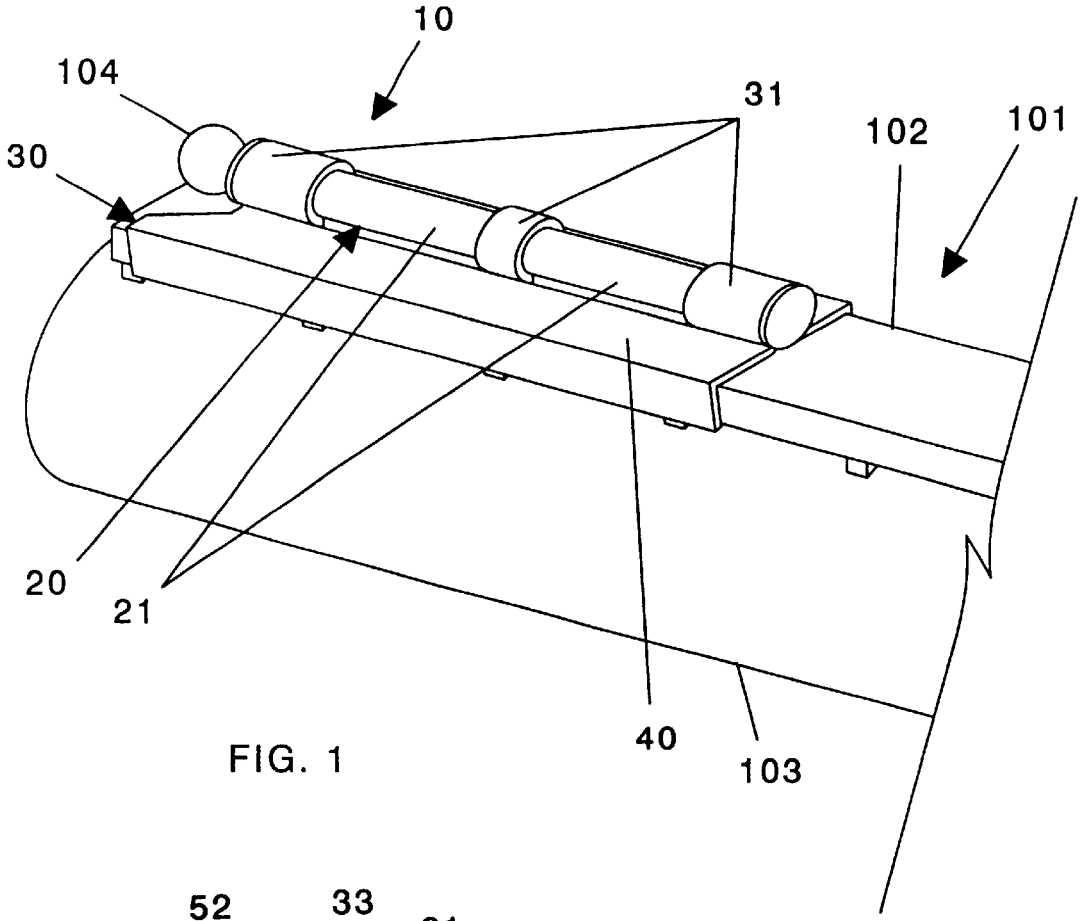
FIG. 1 is a rear perspective view of a preferred embodiment of the sighting device of the present invention shown to be installed on the rib of a gun.

Referring now to the drawings in which like reference numerals designate like or corresponding parts throughout the several views, there is shown in FIG. 1 a weapon, such as a gun (101), having a barrel assembly (103) with a rib (102) attached along an upper edge of the barrel assembly (103). A bead sight (104) is typically attached to the rib (102) near a front end of the barrel assembly (103).

A sighting device (10) includes a sighting means and a means for securing the sighting device to the weapon. The sighting means comprises a sight body (20). The means for securing the sighting device to the weapon is a support bracket (30) which includes two main components, namely, means for removably holding the sight body and means for attaching to the weapon. The support bracket (30) further comprises a relaxed state and an expanded state.

In the same figure, the means for removably holding the sight body is shown to comprise a holding element (31), and the means for attaching to the weapon is shown to comprise an attaching base (40).

Figure 2:
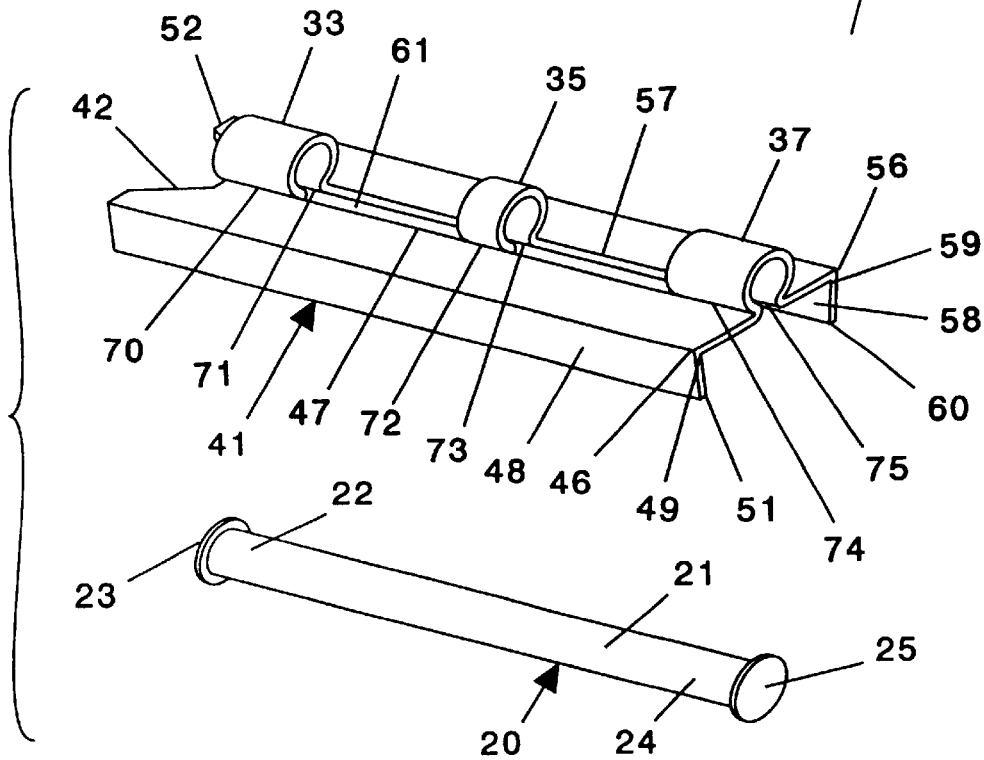
FIG. 2 is an exploded rear perspective view of the sighting device of FIG. 1.
Figure 3:
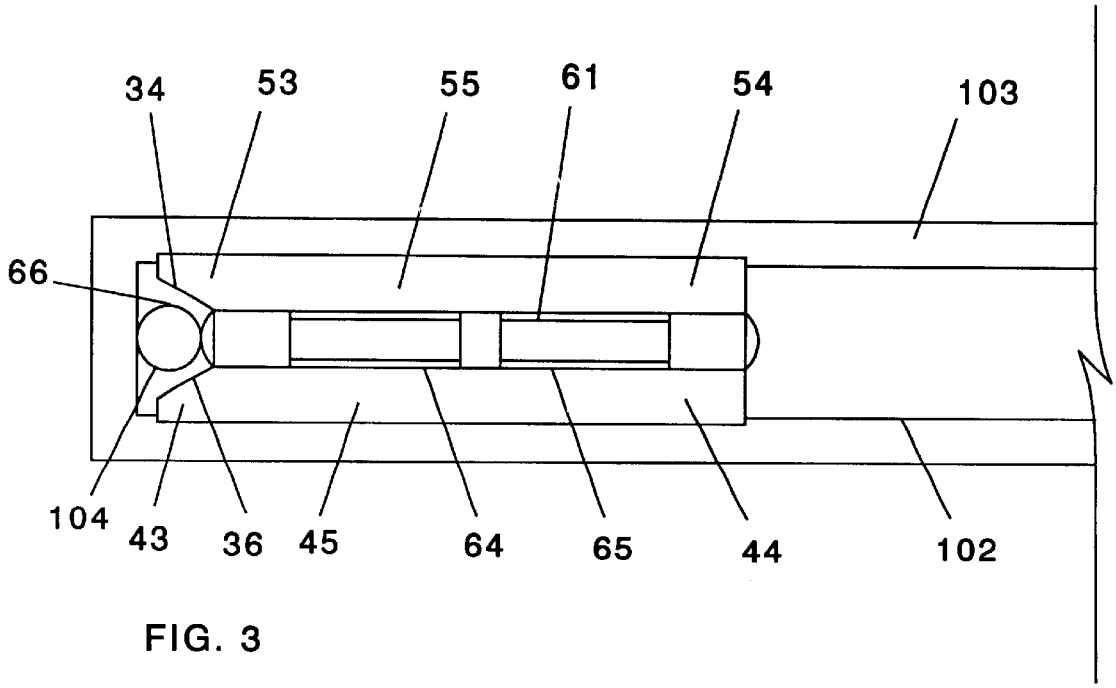
FIG. 3 is a top plan view of the sighting device shown in FIG. 1 positioned on the rib of weapon.

Referring to the preferred embodiment in FIGS. 2 and 3, the sight body (20) comprises a fiber optic element (21) having a first end (22) and a second end (24). Positioned on the first end (22) is a first enlarged portion (23). Likewise, on the second end (24) of the fiber optic element (21) there is located a second enlarged portion (25).

The attaching base (40) of this preferred embodiment is a resilient clamp (41) which is formed by a pair of generally L-shaped pieces. An elongate opening (61) extends between the L-shaped pieces, and a receiving area (66) is located at one end thereof.

The L-shaped pieces comprise a left L-shaped piece (42) and a right L-shaped piece (52). The left (42) and right (52) L-shaped pieces are similar in form, wherein the right L-shaped piece (52) has a right arm plate (55) and an adjoining right leg plate (58). Similarly, the left L-shaped piece (42) includes a left arm plate (45) and a left leg plate (48).

The holding element (31) preferably comprises a plurality of resilient clips. Spaces are disposed between the resilient clips. The resilient clips comprise a first spring clip (33), a second spring clip (35) and a third spring clip (37). Each of the first (33), second (35) and third (37) spring clips have a pair of opposing outer ends which are integrally formed with the attaching base (40) as shown in FIG. 2. The opposing outer ends of the first spring clip (33) include a left (70) and right (71) outer end. Likewise, the opposing outer ends of the second (35) and third (37) spring clips each include a respective left (72,73) and right (74,75) outer end.

The spaces extending between the spring clips (33,35,37) include a first space (64) and a second space (65). Although three spring clips are shown in this preferred embodiment, the number of clips used and the resultant number of spaces accompanying the spring clips can vary as desired by one skilled in the art. A single spring clip could be used if desired.

Preferably, the fiber optic element (21) has an elongated cylindrical shape and the spring clips (33,35,37) are generally C-shaped. Accordingly, the fiber optic element (21) has a circular cross section and it is preferred that the exterior surface of the sight body (20) substantially conform to the interior C-shape of the spring clips.

The support bracket (30), which includes both the spring clips (33, 35, 37) and the resilient clamp (41), is preferably made from spring steel. Consequently, the support bracket (30) exhibits a certain degree of resilience which results in a tendency of the support bracket (30) to return to a relaxed state after being flexed. Other types of suitable resilient materials, as are known in the art, could be used in lieu of spring steel to comprise the support bracket (30).

The fiber optic element (21) is preferably comprised of a fiber optic material having a fluorescent tinted color. Different colored fiber optic materials, such as are known in the art, can be used to tint the fiber optic element as desired. Additionally, alternate fiber optic elements (21) having different colors, for example, can be used interchangeably with the sighting device.

The fiber optic element (21) "collects" or absorbs surrounding light through its longitudinal surfaces that are exposed to the light. The collected or absorbed light is subsequently conducted within the material of the fiber optic element (21) and is emitted in a concentrated form through the first (23) and second (25) enlarged portions at the respective first (22) and second (24) ends of the fiber optic element (21). It is generally recognized with such fiber optic elements that the larger the surface area of the element exposed to the light, the larger the concentration of light that is emitted at the ends of the fiber optic element.

The support bracket (30) releasably holds the sight body (20) and attaches the sighting device (10) to the barrel assembly (103) of a gun. The attaching base (40) of the support bracket (30) is a resilient clamp (41) having leg plates (48,58) that snap onto and grasp opposite sides of the gun's rib to secure the sighting device on the barrel assembly (103).

The resilient clamp (41) is flexible which enables the leg plates (48,58) to be flexed relative to the respectively attached arm plates (45,55). The leg plates (48,58) are flexed in a direction away from each other to create an inwardly biasing force within the leg plates (48,58). This biasing force is a clamping force to secure the leg plates (48,58) to the rib.

Similarly, the resilient spring clips (33,35,37) can be flexed by forcing the left (70,72,74) and right (71,73,75) outer ends in a direction away from each other. This flexing also creates an inwardly biasing force within the respective spring clips (33,35,37).

The leg plates (48,58) and spring clips (33,35,37) can flex independently of each other or alternately, the plates (48,58) and clips (33,35,37) can flex simultaneously with each other. When flexing simultaneously, the inwardly biasing force of the spring clips (33,35,37) cooperates with the inwardly biasing force of the leg plates (48,58) to create an enhanced gripping strength that is imparted through the leg plates (48,58) to attach the support bracket (30) to the weapon.

When both the leg plates (48,58) and the spring clips (33,35,37) are flexing simultaneously, the leg plates (48,58) can extend a greater distance apart from each other than when only the leg plates (48,58) are flexing. Therefore, this cooperation between the spring clips (33,35,37) and leg plates (48,58) provides the support bracket (30) with greater adjustability potential for attaching to differently sized ventilation ribs as they may vary from gun to gun.

It should be noted that when the leg plates (48,58) flex independently of the spring clips (33,35,37), the former can still create a biasing force that can attach the support bracket (30) to the weapon. Likewise, when the spring clips (33,35, 37) flex independently of the leg plates (48,58), the spring clips (33,35,37) can also create a biasing force that can attach the support bracket (30) to the weapon.

Additionally, the spring clips (33,35,37) releasably hold the fiber optic element (21) on the support bracket (30).

When the fiber optic element (21) is held within the spring clips (33,35,37), longitudinal movement of the fiber optic element (21) relative to the clips (33,35,37) is limited by the first (23) and second (25) enlarged portions on the ends of the fiber optic element (21).

The left arm plate (45) is defined by an outer edge (46) and an inner edge (47). Like the left arm plate (45), the right arm plate (55) also includes an outer edge (56) and inner edge (57). Regarding the left (48) and right (58) leg plates, the left leg plate (48) is bounded on two opposing sides by an upper edge (49) and a lower edge (51), while the right leg plate (58) also has an upper edge (59) and an opposing lower edge (60). On the left L-shaped piece (42) the upper edge (49) of the left leg plate (48) is adjoined to the outer edge (46) of the left arm plate (45) and on the right L-shaped piece (52), the upper edge (59) of the right leg plate (55) is attached to the outer edge (56) of the right arm plate (55).

Figure 4:
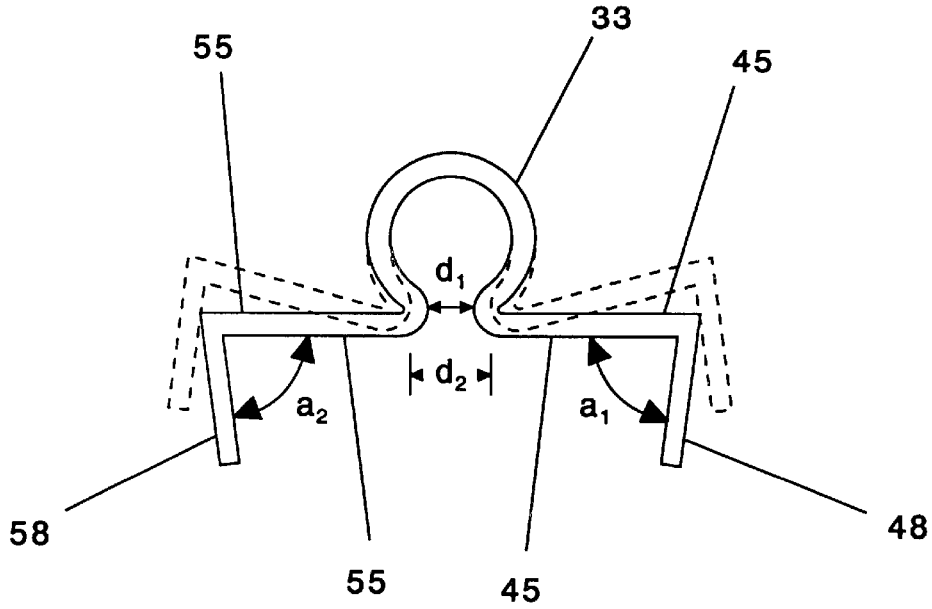
FIG. 4 is a front view of the resilient clamp of a preferred embodiment of the present invention in which the resilient clamp is shown in the relaxed state and also shown in dotted lines in the expanded state.

Referring to FIG. 4, the left arm plate (45) and left leg plate (48) adjoin to define a first included angle ($a_1$) on the left L-shaped piece (42). Similarly, on the right L-shaped piece (52), the right arm plate (55) and the adjoining right leg plate (58) form a second included angle ($a_2$) therebetween. Preferably, the first ($a_1$) and second ($a_2$) included angles are less than about 90 degrees when the support bracket (30) is in a relaxed state. The magnitude of the first and second included angles can vary as the leg plates (48,58) flex.

As shown in FIG. 3, the first (33), second (35) and third (37) spring clips are disposed along a length of the resilient clamp (41). The first space (64) is located between the first (33) and second (35) spring clips, while the second space (65) is between the second (35) and third (37) spring clips.

Preferably, the diameter of the fiber optic element (21) is approximately equal to or slightly greater than the inner diameters of the spring clips (33,35,37) in the relaxed state. This enables the latter to hold the fiber optic element (21) in place on the support bracket (30).

It should be noted here that when the outer diameter of the fiber optic element (21) is slightly greater than the inner diameters of the spring clips (33,35,37), there is a slight biasing force exerted by the spring clips (33,35,37) on the fiber optic element (21). This biasing force is considered to be negligible when defining the relaxed state of the support bracket (30) herein.

In some instances the portion of the fiber optic element (21) extending between the first (23) and second (25) enlarged portions can have a diameter that is less than the inner diameter of the spring clips (33,35,37). However, it is not preferred. Additionally, the diameters of the enlarged portions (23,25) are greater than the diameter of that portion of the fiber optic element (21) between the enlarged portions (23,25), as well as being greater than the inner diameters of the resilient clips when in the relaxed state.

When the support bracket (30) is in a relaxed state, the diameter of the fiber optic element (21) is greater than the distance between respective left (70,72,74) and right (71, 73,75) outer ends of the spring clips (33,35,37) in order to retain the element (21) on the support bracket (30). Conversely, when the support bracket (30) is in the expanded state, the diameter of the fiber optic element (21) is less than the distance between the respective left (70,72, 74) and right (71,73,75) outer ends which allows the fiber optic element (21) to be removed from the support bracket (30) and/or to allow a fiber optic element (21) to be mounted in the holding element (31).

The opposing outer ends of the respective first (33), second (35) and third (37) spring clips are attached to the inner edges (47,57) of the arm plates (45,55). The respective left outer ends (70,72,74) are attached to the inner edge (47) of the left arm plate (45), while the respective right outer ends (71,73,75) are attached to the inner edge (57) of the right arm plate (55). These inner edges (47,57) define the sides of the elongate opening (61) in the support bracket (30).

Consequently, when the spring clips (33,35,37) flex,- the distance between the left (70,72,74) and right (71,73,75) opposing outer ends changes, the distance between the inner edges (47,57) of the left (45) and right (55) arm plates changes, and the width of the elongate opening (61) changes. The width of the elongate opening (61) varies in direct proportion to any change in distance between the respective left (70,72,74) and right (71,73,75) outer ends of the spring clips (33,35,37), and in direct proportion to any change in distance between inner edges (47,57) of the arm plates (45,55). It follows that as these distances and widths change, the distance between the leg plates (48,58) also varies.

The support bracket (30) of this preferred embodiment includes the relaxed state as shown in solid lines in FIG. 4 and the expanded state as shown in the dotted lines. The width of the elongate opening (61) and the distance between the opposing outer ends correspond in magnitude at the locations along the inner edges (47,57) where outer ends are attached to the respective inner edges (47,57). Both the width and the distance are indicated by the letter "d" in FIG. 4.

In the relaxed state, the width at $d_1$ is of a magnitude less than a smaller diameter of the portion of the fiber optic element (21 ) which extends between the first (22) and second (24) ends. In the extended state, the width at $d_2$ is a magnitude of greater dimension than the smaller diameter of the fiber optic element (21). The support bracket (30) can be flexed from the relaxed state to the expanded state by forcing the left (45) and right (55) leg plates outwardly from each other until the distances between the opposing outer ends of the respective spring clips (33,35,37) are greater than the fiber optic element's smaller-diameter. The support bracket (30) is flexed to the expanded state in order to remove or insert the fiber optic element (21) on the holding element (31). It should be noted that it is not desirable to flex the support bracket (30) to its expanded state when mounting the sighting device (10).

On the resilient clamp (41), each of the left (42) and right (52) L-shaped pieces have a respective front end (43, 53) and a respective rear end (44, 54), as shown in FIG. 3. The front end (53) of the right L-shaped piece (52) has an angled edge (34) extending from its inner edge (57) outwardly towards the front end (53). An angled edge (36) on the left L-shape piece (42) mirrors that angled edge (34) of the right L-shaped piece (52) by extending outwardly from the inner edge (47) of the left arm plate (45) towards the front end (43). The angled edges (34,36) of the right (55) and left (45) arm plates cooperate to form the generally V-shaped receiving area (66).

In the preferred embodiment of FIGS. 2 and 3, the left (45) and right (55) arm plates of the respective L-shaped pieces (42,52) are positioned in a side by side relationship with the plates being generally coplanar. The inner edges (47, 57) of the respective left (45) and right (55) arm plates are substantially aligned and spaced apart to define the elongate opening (61) of the support bracket (30).

The fiber optic element (21) is positioned adjacent to and aligned with the elongate opening (61). Each of the spring clips (33,35,37) partially encircles the circumference of the fiber optic element (21) at different locations along the length thereof. The first (23) and second (25) enlarged portions on the fiber optic element (21) are positioned near the first (33) and third (37) spring clips respectively, such that the first enlarged portion (23) is on the side of the first spring clip (33) opposite the first space (64) and the second enlarged portion (25) is on the side of the third spring clip (37) opposite the second space (65). Thus positioned, the enlarged portions (23,25) limit longitudinal sliding movement of the fiber optic element (21) within the holding element (31) of the support bracket (30). Preferably, the first (23) and second (25) enlarged portions abut the respective outer sides of the first (33) and third (35) spring clips.

Figure 5A:
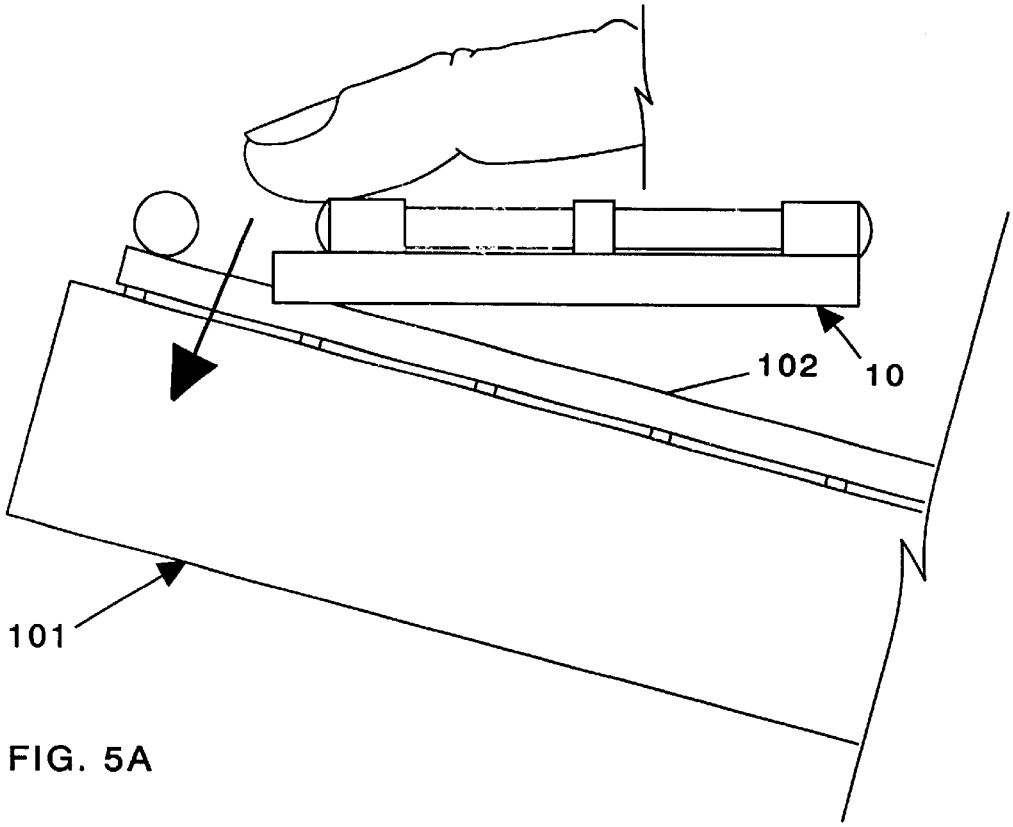
FIGS. 5A–5C are side views showing a preferred installation of the sighting device of FIG. 1.
Figure 5B:
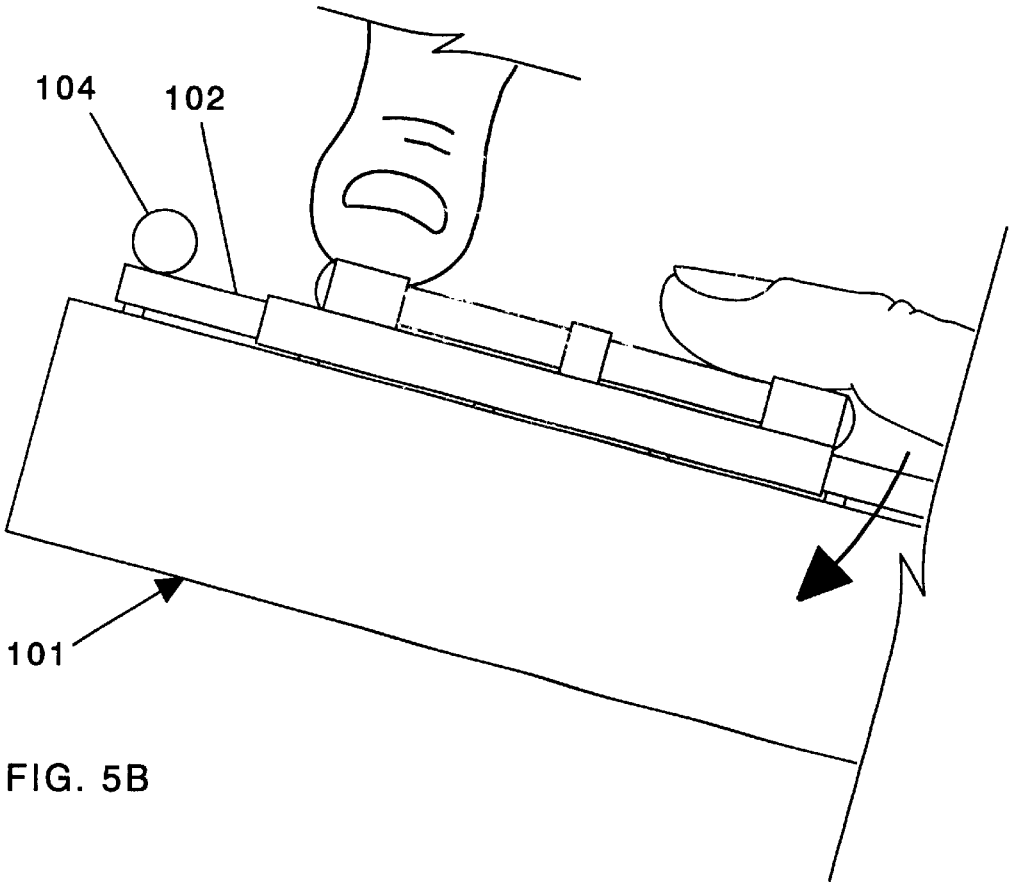

To install the sighting device (10), a small amount of oil is applied to the area where the device is to be mounted on the gun. The support bracket (30) of the sighting device (10) is aligned with the rib of the gun, such that the left (48) and right (58) leg plates are adjacent to respective opposites sides of the rib, and the V-shaped receiving area of the resilient clamp (41) is directed towards the bead sight on the gun. A corner of one of the left or right leg plate's outer edges is flexed outwardly by placing the inside surface of the one corner against the side of the rib and moving the device laterally. As the one corner of the leg plate spreads away from the opposite corner and the associated leg plate, the device is pressed downwardly to engage the opposite corner with the opposing side of the rib as shown in FIG. 5A. By continuing to press downwardly on the engaged end of the device (10), the support bracket (30) is pivoted toward the rib (102). As the bracket (30) pivots, the unengaged end of the bracket is pressed downwardly and the remaining portions of the lower edges (51,60) of the left (48) and right (58) leg plates are forced down and apart to engage the sides of the rib (102) as shown in FIG. 5B.

Figure 5C:
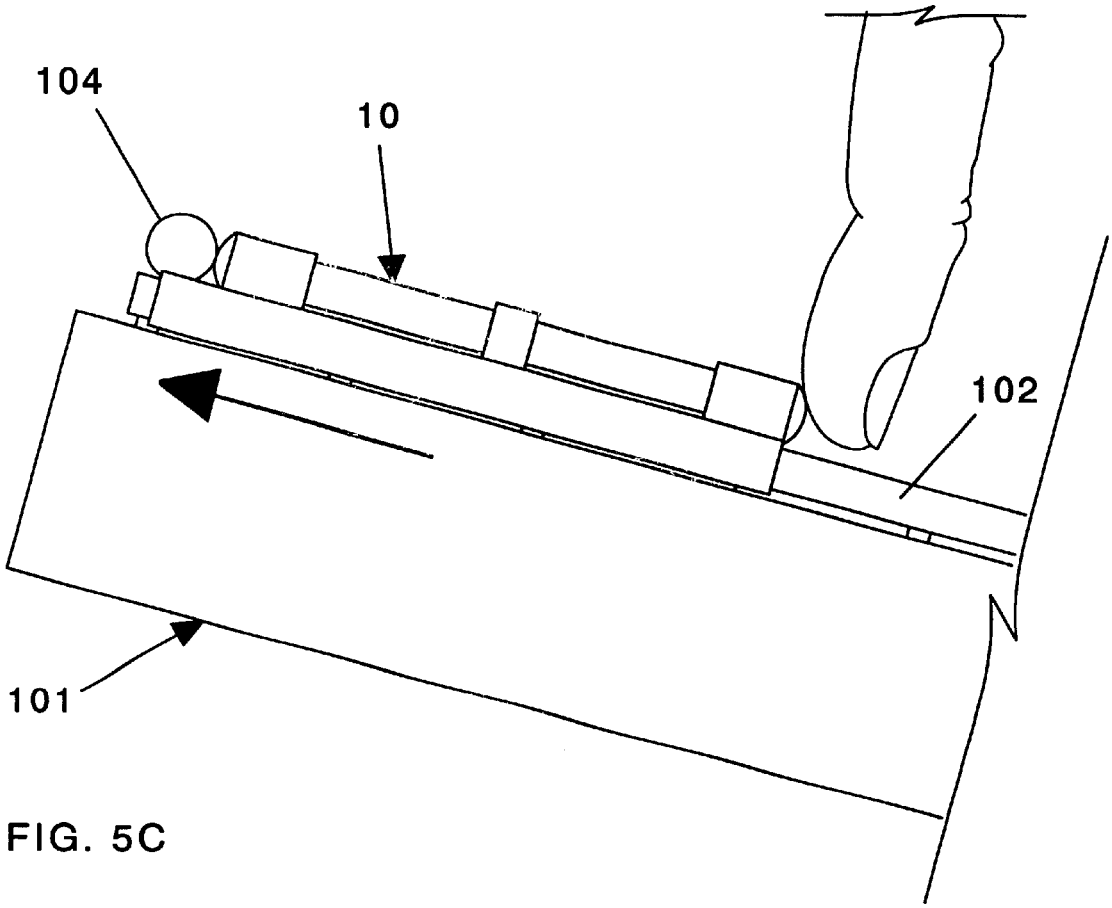

Referring now to FIG. 5C, the sighting device (20) is then slid along the rib towards the bead sight (104) until the V-shaped receiving area (66) of the sighting device (10) is directly adjacent to the bead sight (104) or the sighting device (10) abuts the bead sight (104). In some cases where the barrel assembly (103) lacks a bead sight, the sighting device can be slid along the ribs to the desired location, or alternately, the device can be mounted directly to the desired location.

To remove the sighting device (10) from the rib (102), a small amount of oil is applied to the device (10) at a location between the support bracket (30) and the rib (102). The rear end of the resilient clamp (41) is pried upwardly from the rib using a thumbnail. A knife blade or other known equivalent could be used in lieu of a thumbnail, if desired. The rear end of the clamp (41) is moved upwardly away from the rib (102) until the leg plates (48,58) are completely separated from the sides of the rib (102).

Alternately, the sighting device (10) can be removed by sliding the device (10) away from the bead sight (104) and prying the front end of the clamp from the rib while bracing the rear end against movement.

The sighting device of the present invention, primarily for use in low light conditions, can be quickly mounted on a gun, then easily removed from the gun when the sight is no longer needed. The support bracket of the sighting device has enhanced strength to securely attach to the gun during use to not only deter detachment of the device from the gun, but also to maintain sighting accuracy during use. In addition, the holding element allows the fiber optic element in the sighting device to be interchanged with various other selected fiber optic elements when it is desired to use a different optic element.

Although the present invention has been described in considerable detail with reference to certain preferred versions thereon, other versions are possible. Therefore, the spirit and scope of the appended claims should not be limited to the description of the preferred versions contained herein.

What is claimed is:

1. A sighting device for a weapon having a barrel assembly which includes a rib, said sighting device comprising:

a sight body; and means for securing the sighting device to the weapon, said securing means comprising a means for removably holding the sight body and means for attaching to the weapon;

said means for attaching to the weapon is a resilient attaching base which includes right and left pieces;

an elongate opening extends between the right and left pieces;

said sight body comprises a fiber optic element disposed in said means for releasably holding the sight body;

wherein said elongate opening is contiguous with said sight body.

2. The sighting device of claim 1, wherein the means for removably holding the sight body comprises a resilient clip connected to the means for attaching to the weapon and which removably engages the sight body.

3. The sighting device of claim 2, wherein said fiber optic element being generally cylindrically-shaped and having a first end, a second end, a first enlarged portion disposed on the first end of the fiber optic element, and a second enlarged portion disposed on the second end of the fiber optic element.

4. The sighting device of claim 1, wherein the means for removably holding the sight body comprises a plurality of spring clips which releasably engage the sight body.

5. The sighting device of claim 4, wherein said plurality of spring clips comprises a first spring clip, a second spring clip and a third spring clip; and said first, second and third spring clips are spaced apart on said resilient attaching base.

6. The sighting device of claim 4, wherein each of said spring clips have a pair of opposing outer ends that are attached to said resilient attaching base, wherein one of said opposing outer ends of each said spring clip is attached to said left piece of said resilient attaching base and an other of said opposing outer ends of each said spring clip is attached to said right piece, and said elongate opening extends between each pair of said opposing outer ends.

7. The sighting device of claim 1 wherein said sight body is aligned substantially longitudinally with the elongate opening.

8. The sighting device of claim 1, wherein said means for removably holding the sight body comprises a resilient clip attached to the left and right pieces.

9. A sighting device for a weapon having a barrel assembly which includes a rib, said sighting device comprising:

a sight body; and means for securing the sighting device to the weapon, said securing means comprising a means for removably holding the sight body and means for attaching to the weapon, said means for removably holding the sight body comprises a plurality of spring clips which releasably engage the sight body;

said sight body comprises a fiber optic element; said means for attaching to the weapon comprise right and left pieces adapted to grip the weapon; and an elongate opening extends between the right and left pieces.

10. A sighting device for a weapon having a barrel assembly which includes a rib, said sighting device comprising:

a sight body; and a support bracket which includes a resilient clip and a resilient attaching base which releasably secures the support bracket to the weapon;

said resilient clip comprises a plurality of spring clips which releasably secure the sight body to the support bracket; and said sight body includes a fiber optic element;

each of said spring clips has a pair of opposing outer ends that are mounted directly to said resilient attaching base, and said opposing outer ends are allowed to flex.

11. The sighting device of claim 10, wherein said resilient attaching base comprises a left piece and a right piece, and said left and right pieces are adapted to clamp on to the weapon.

12. The sighting device of claim 11, further comprising a generally V-shaped receiving area formed,on one end of said attaching base.

13. The sighting device of claim 10, wherein said plurality of spring clips comprises a first spring clip, a second spring clip and a third spring clip; and said first, second and third spring clips are mounted on said attaching base such that a first space is located between the first and second spring clips and a second space is located between said second and third clips.

14. The sighting device of claim 10, wherein said attaching base comprises a resilient clamp.

15. The sighting device of claim 10, wherein said sight body having a generally cylindrical shape, a first end, a second end, a first enlarged portion disposed on the first end; and a second enlarged portion disposed on the second end.

16. The sighting device of claim 10, wherein said attaching base includes a right substantially L-shaped piece and a left substantially L-shaped piece.

17. The sighting device of claim 16, wherein said sight body is a fiber optic element;

an elongate opening extends between the left and right substantially L-shaped pieces; and said resilient clip is attached to the respective left and right substantially L-shaped pieces.

18. A sighting device for a weapon having a barrel assembly which includes a rib, said sighting device comprising:

a sight body which comprises a fiber optic element; and a support bracket which includes a resilient clip and an attaching base;

said resilient clip comprises a plurality of spring clips that releasably receive the sight body and said attaching base comprises a left and right piece that releasably clamp on to the weapon;

said fiber optic element is elongated with a substantially cylindrical shape;

an elongate opening extends between the right piece and the left piece of the attaching base; and said fiber optic element is substantially longitudinally aligned with said elongate opening.

19. The sighting device of claim 18, wherein each of said spring clips has a respective left outer end and a respective right outer end, and each of said left outer ends are attached to said left piece and each of said right outer ends are attached to said right piece.

20. The sighting device of claim 19, wherein said spring clips span the elongate opening.

21. The sighting device of claim 20, wherein the left piece is substantially L-shaped comprised by a left arm plate and a left leg plate having a first included angle therebetween, said right piece is substantially L-shaped comprised by a right arm plate and a right leg plate having a second included angle therebetween.

22. The sighting device of claim 21, wherein said first and second included angles are less than approximately 90 degrees.

23. The sighting device of claim 22, wherein said left arm plate has an inner edge and said right arm plate has an inner edge, said left and right inner edges define opposite sides of the elongate opening, said left outer ends of said spring clips are attached to said inner edge of said left arm plate and said right outer ends of said spring clips are attached to said inner edge of said right arm plate.

24. A sighting device for a weapon having a barrel assembly which includes a rib, said sighting device comprising:

(a) a fiber optic element; and (b) a support bracket for attaching the sighting device to the weapon, said support bracket further comprising a holding element and an attaching base;

said fiber optic element is substantially cylindrical shaped;

said holding element comprises a first spring clip, a second spring clip and a third spring clip, wherein each said first, second and third spring clips are substantially C-shaped and include respective right and left opposing outer ends;

said attaching base includes a resilient clamp comprising left and right substantially L-shaped pieces;

said left substantially L-shaped piece has a front end and a rear end, and further comprises a left arm plate and a left leg plate, wherein said left arm plate has an outer edge and an inner edge, and said left leg plate has an upper edge and a lower edge, said outer edge of said left arm plate is attached to said upper edge of said left leg plate;

said right substantially L-shaped piece has a front end and a rear end, and further comprises a right arm plate and a right leg plate, wherein said right arm plate has an outer edge and an inner edge, said right leg plate has an upper edge and a lower edge, said outer edge of said right arm plate is attached to said upper edge of said right leg plate;

said left and right arm plates are positioned in an approximate side by side relationship with the inner edges of the left and right arm plates spaced apart to define an elongate opening therebetween;

said left and right substantially L-shaped pieces have a respective angled edge extending from the inner edge of each respective left and right arm plate outwardly towards the front end of the respective substantially L-shaped piece, wherein said angled edges cooperate to form a generally V-shaped receiving area on the attaching base;

wherein each of the left and right opposing outer ends of the first spring clip are attached to the inner edges of the respective left and right arm plates at the front ends thereof, each of the left and right opposing outer ends of the third spring clip are attached to the inner edges of the respective left and right arm plates at the rear ends thereof; and each of the left and right opposing outer ends of the second spring clip are attached to the inner edges of the respective left and right arm plates at a location intermediate the front and rear ends thereof;

a first space is located between the first and second spring clips, and a second space is located between the second and third spring clips;

said fiber optic element is held by the first, second and third spring clips such that the first enlarged portion is adjacent to a side of said first spring clip which is opposite the second spring clip and the second enlarged portion is adjacent to a side of said third spring clip which is opposite the second spring clip.

* * * * *

UNITED STATES PATENT AND TRADEMARK OFFICE

CERTIFICATE OF CORRECTION

PATENT NO. : 6,446,377 B1 
DATED : September 10, 2002
INVENTOR(S) : Ned J. Hollenbach and Dean N. Williams It is certified that error appears in the above-identified patent and that said Letters Patent is hereby corrected as shown below:

Column 10,
Line 17, change "22" to -- 21 --.

Signed and Sealed this

Seventh Day of January, 2003

JAMES E. ROGAN
*Director of the United States Patent and Trademark Office*